US011104475B1

(12) United States Patent
Greene

(10) Patent No.: US 11,104,475 B1
(45) Date of Patent: Aug. 31, 2021

(54) POCKET HOLDER AND AN EASEL

(71) Applicant: Stanley Ewing Greene, Dallas, TX (US)

(72) Inventor: Stanley Ewing Greene, Dallas, TX (US)

( * ) Notice: Subject to any disclaimer, the term of this patent is extended or adjusted under 35 U.S.C. 154(b) by 0 days.

(21) Appl. No.: 16/524,148

(22) Filed: Jul. 28, 2019

Related U.S. Application Data

(63) Continuation-in-part of application No. 16/386,220, filed on Apr. 16, 2019, which is a continuation-in-part of application No. 13/840,903, filed on Mar. 15, 2013, now Pat. No. 10,308,391.

(51) Int. Cl.
*B65D 5/42* (2006.01)
*A47B 97/04* (2006.01)

(52) U.S. Cl.
CPC ..... *B65D 5/42* (2013.01); *A47B 97/04* (2013.01)

(58) Field of Classification Search
CPC ..... A47B 97/04; B65D 5/308; B65D 27/222; B65D 5/52; B65D 5/5206; B65D 73/0021; B65D 25/2802; B65D 27/22; A45C 11/14; A45C 11/18; A45C 2011/003; A45F 2200/0525; G06F 1/1628
USPC ..... 206/45.2, 320, 464, 465; 220/628, 756, 220/770
See application file for complete search history.

(56) References Cited

U.S. PATENT DOCUMENTS

| | | | | |
|---|---|---|---|---|
| 1,765,010 | A * | 6/1930 | Gross | A47G 1/141 248/459 |
| 2,005,027 | A | 6/1935 | Ellsworth | |
| 2,542,180 | A | 2/1951 | Chemlinski | |
| 3,195,850 | A * | 7/1965 | Steiner | A47B 23/043 248/454 |
| 4,149,630 | A | 4/1979 | Transport | |
| 4,479,318 | A | 10/1984 | Russell | |
| 4,708,239 | A | 11/1987 | Bourbon | |
| 4,895,295 | A | 1/1990 | Montgomery et al. | |
| 5,016,814 | A | 5/1991 | Fullerton | |
| 5,398,893 | A | 3/1995 | Barker | |
| 8,235,208 | B2 | 8/2012 | Sirichai et al. | |
| 8,281,924 | B2 | 10/2012 | Westrup | |
| 2007/0102384 | A1* | 5/2007 | Albenda | A47B 96/202 211/85.26 |
| 2010/0294683 | A1 | 11/2010 | Mish | |
| 2011/0247959 | A1 | 10/2011 | Nelson | |
| 2011/0315594 | A1 | 12/2011 | Sielski | |
| 2012/0043234 | A1 | 2/2012 | Westrup | |
| 2013/0048514 | A1 | 2/2013 | Corcoran et al. | |

* cited by examiner

*Primary Examiner* — Anthony D Stashick
*Assistant Examiner* — James M Van Buskirk
(74) *Attorney, Agent, or Firm* — Papalas PLLC

(57) ABSTRACT

Embodiments describe a holder and an easel for holding and/or display one or more items. The holder and the easel are formed from a single piece of material.

7 Claims, 8 Drawing Sheets

POCKET HOLDER AND AN EASEL

RELATED APPLICATIONS

This application is a continuation-in-part application of U.S. patent application Ser. No. 16/386,220, filed on 16 Apr. 2019, entitled A CONTAINER AND STAND FOR A PORTABLE DEVICE, Athe disclosure of which is hereby incorporated herein by reference in its entirety; which is a continuation-in-part application of U.S. patent application Ser. No. 13/840,903, filed on 15 Mar. 2013, entitled A CONTAINER AND STAND FOR A PORTABLE DEVICE, the disclosure of which is hereby incorporated herein by reference in its entirety.

TECHNICAL FIELD

A pocket holder for holding items and an easel for displaying articles or other items and their methods of making and methods of use are provided.

BACKGROUND

Recycling is a process using waste materials to form new products. Recycling prevents waste of new materials, and reduces the consumption of fresh raw materials, as recycling uses discarded or otherwise used materials to form the new products. Recycling may also reduce energy and water usage in the formation of materials from raw ingredients. Recycling also reduces pollution by preventing the disposal of the materials. For example, recycling reduces air pollution from incineration, and land and water pollution from land filling. Recycling is a key component of modern waste reduction and is the third component of the "Reduce, Reuse, Recycle" waste hierarchy.

SUMMARY

Embodiments of the invention are directed to a holder and an easel. A first embodiment is a holder that holds an item, the holder comprises: a pocket that holds the item; and a back surface that is adjacent to and in contact with the pocket; wherein the pocket comprises: first and second pocket latch tabs that are adjacent to and in contact with the back surface; a bottom pocket surface; a front pocket surface that is connected to the bottom pocket surface and proximate to the back surface; first and second pocket side surfaces that are each connected to the front pocket surface and the back surface; a rear pocket surface that is connected to the bottom pocket surface and connect to the first and second pocket latch tabs; wherein the front pocket surface, the first and second pocket side surfaces, the rear pocket surface, and the bottom pocket surface are located proximate with each other to form a pocket of the holder; wherein the first and second side pocket surfaces and the first and second pocket latch tabs operate to maintain the pocket; and wherein the pocket and the back surface are formed from a single piece of material.

A second embodiment is an easel that holds an item, the easel comprises: a pocket that holds the item; and a support that is adjacent to and in contact with the pocket; wherein the pocket comprises: first and second pocket latch tabs that are adjacent to and in contact with the support; a lower inside surface that that connected to the first and second pocket latch tabs; a front pocket surface that is connected to the lower inside surface and proximate to the support; first and second side support surfaces that are each connected to the front pocket surface and the support; wherein the lower inside surface and the front pocket surface, and the first and second side support surfaces are proximate with each other to form the pocket that has a polygon shaped cross-section; wherein the support comprises: a flap surface that is adjacent to the pocket and in contact with the lower inside surface; a base surface that is connected to the flap surface; a back surface that is connected to the base surface; a front top surface that is connected to the back surface and the first and second side support surfaces; wherein the flap surface and the base surface, the back surface, and the front top surface are proximate with each other to form the support that has a polygon shaped cross-section; wherein the pocket and the support are formed from a single piece of material.

BRIEF DESCRIPTION OF THE DRAWINGS

Having thus described the invention in general terms, reference will now be made to the accompanying drawings, which are not necessarily drawn to scale, and wherein:

FIGS. 1A-1E depict an embodiment of a pocket holder;

FIGS. 2A-2E depict and embodiment of an easel; and

Figure 1A:
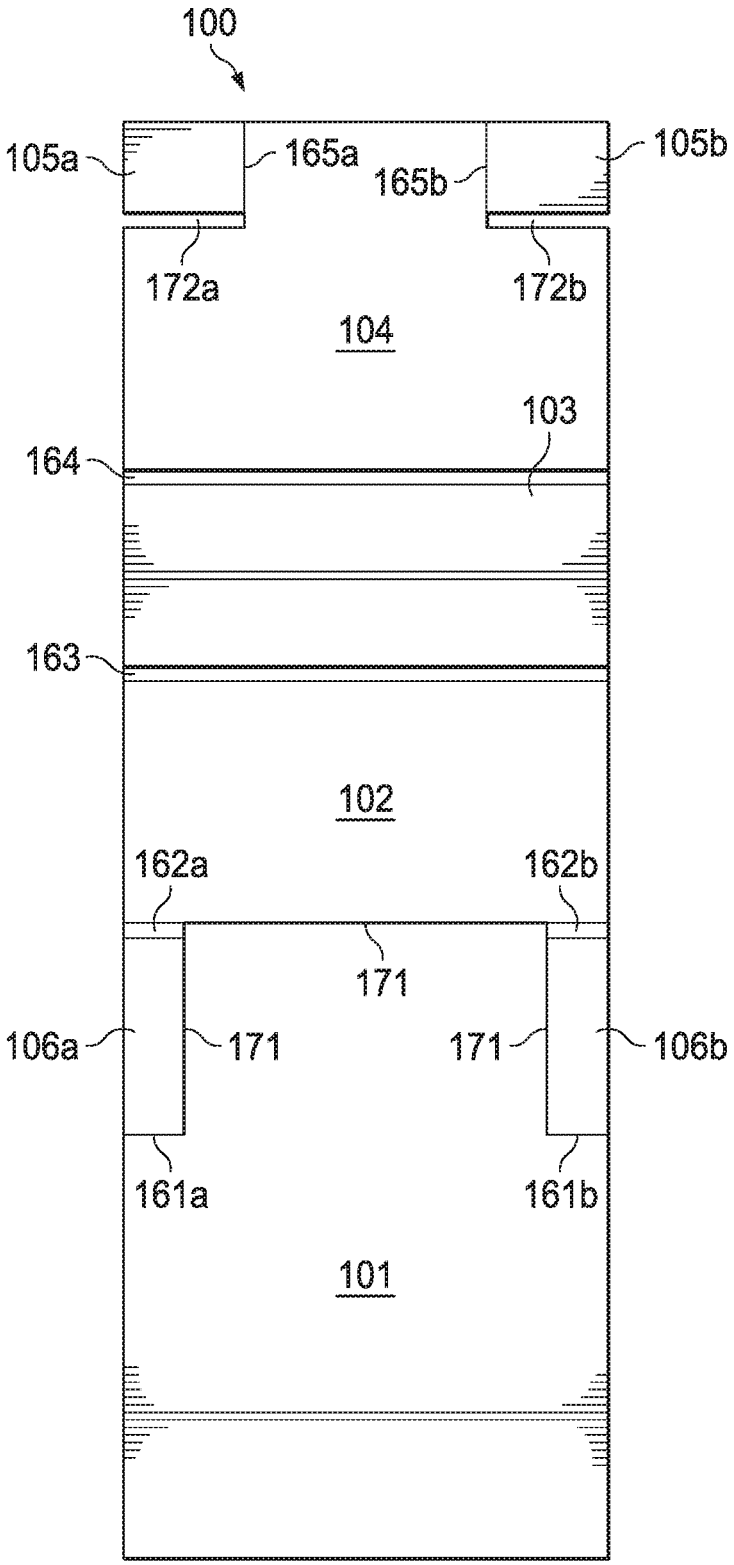
Figure 1B:
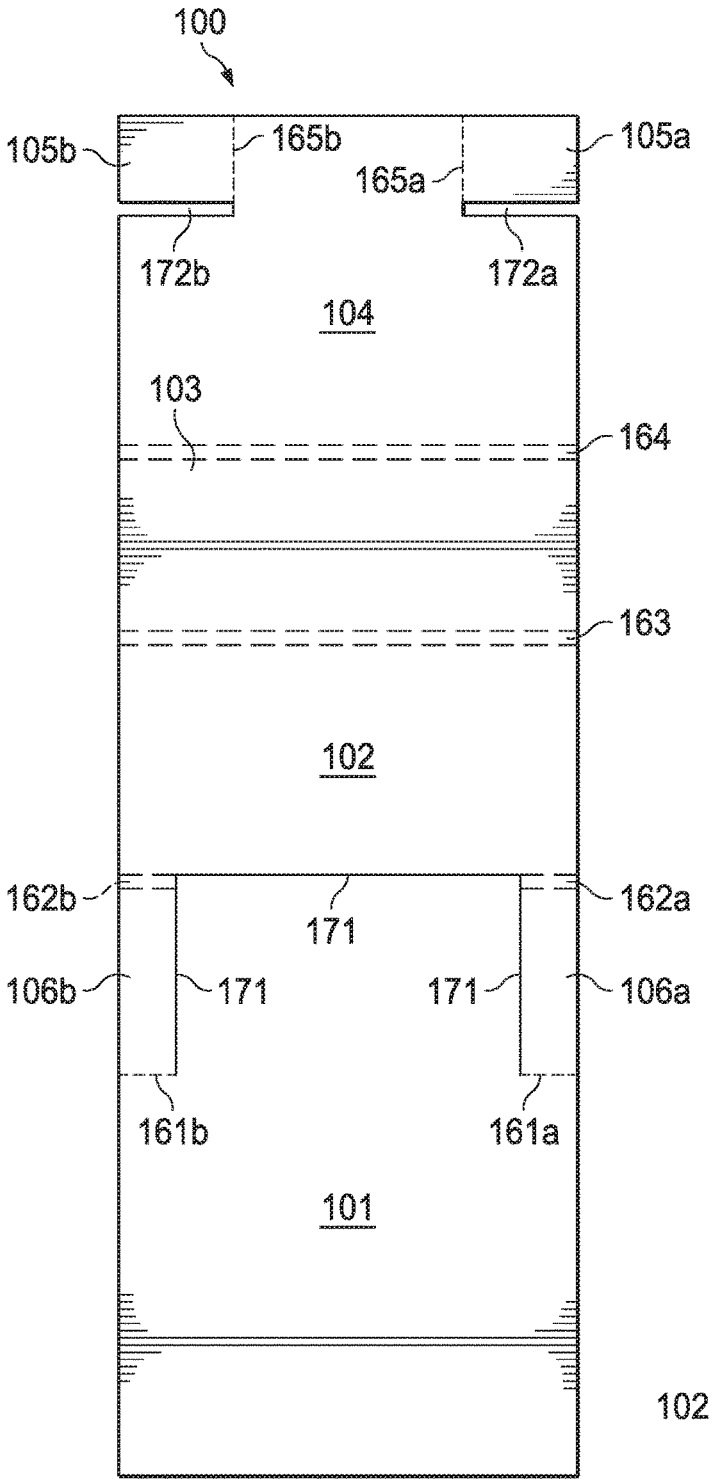
Figure 1C:
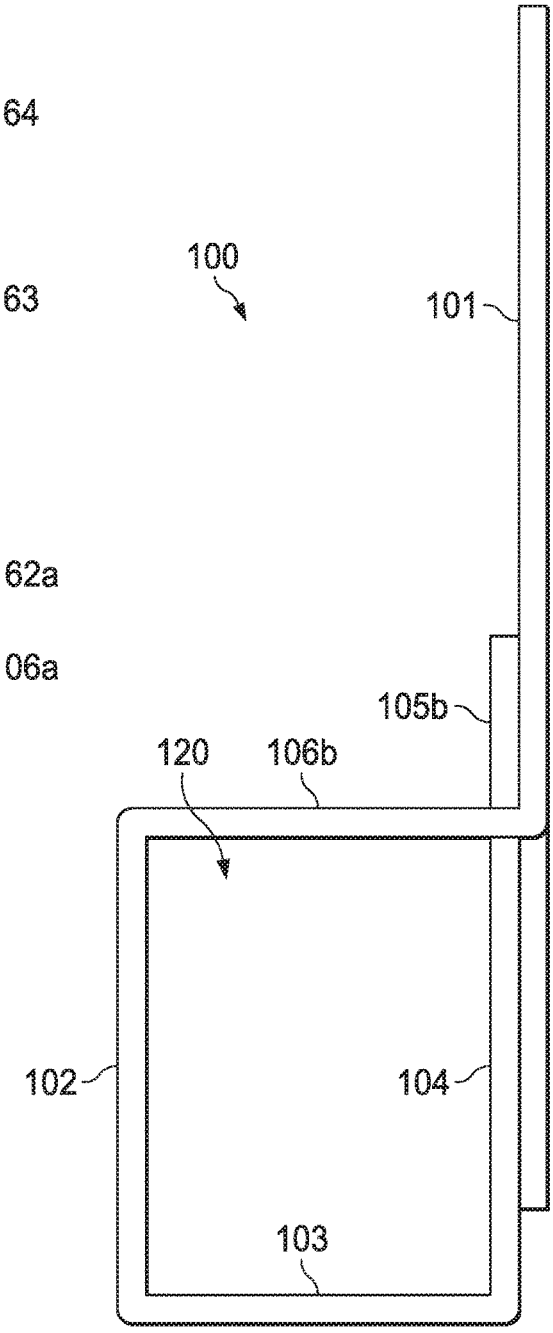
Figure 1D:
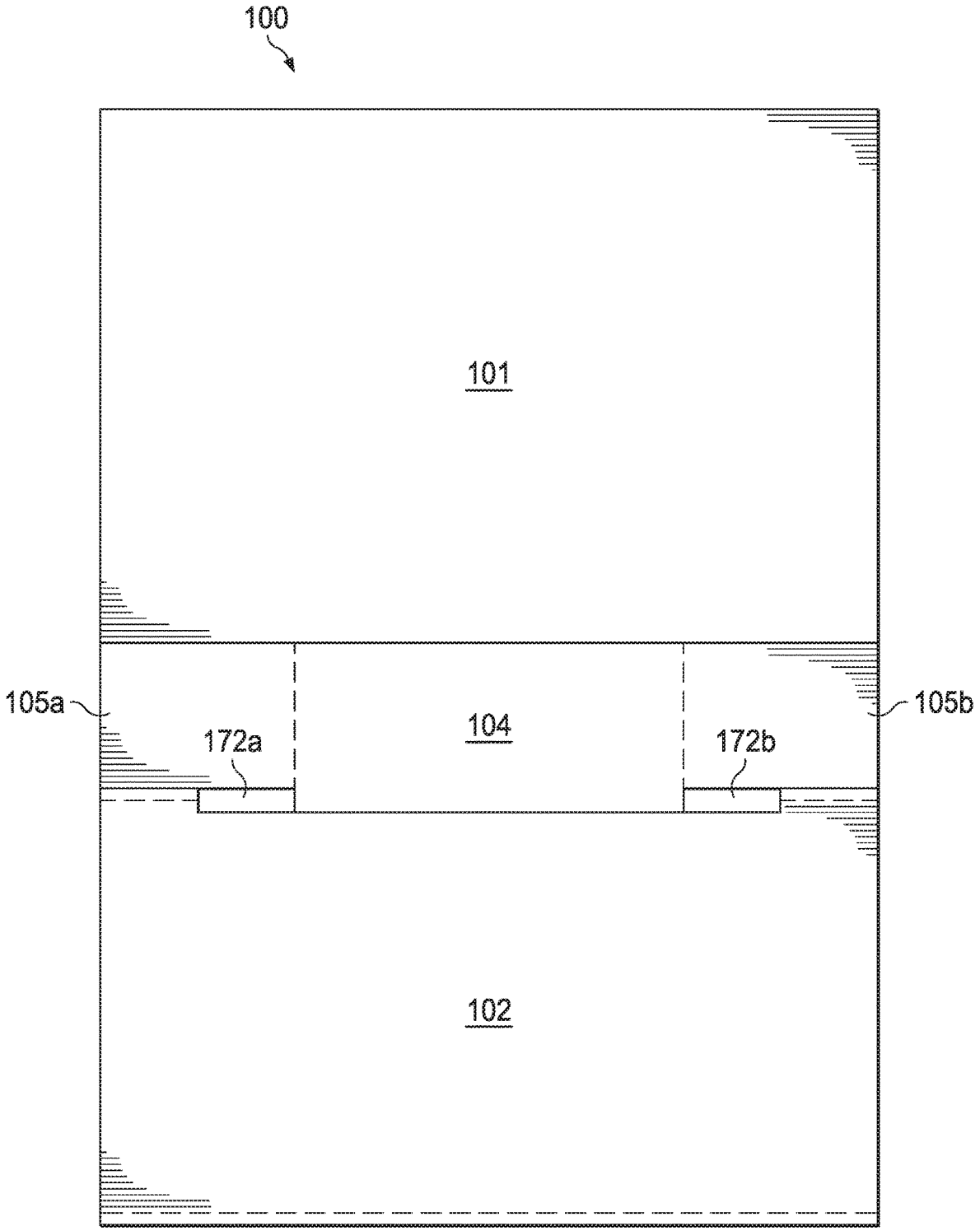
Figure 1E:
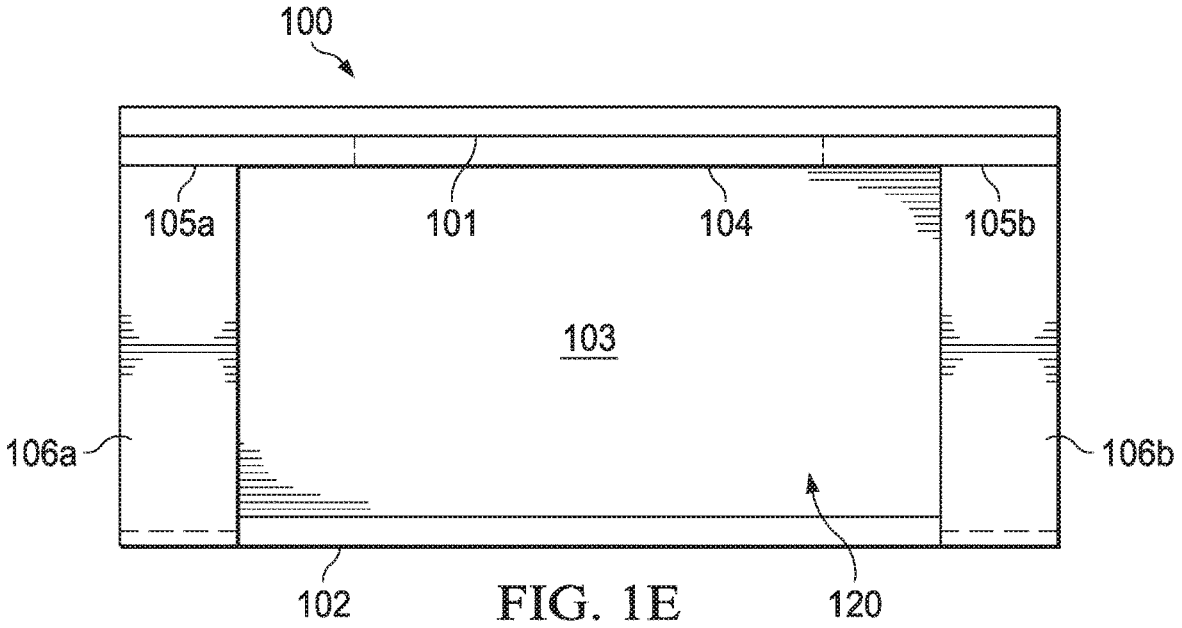
Figure 2B:
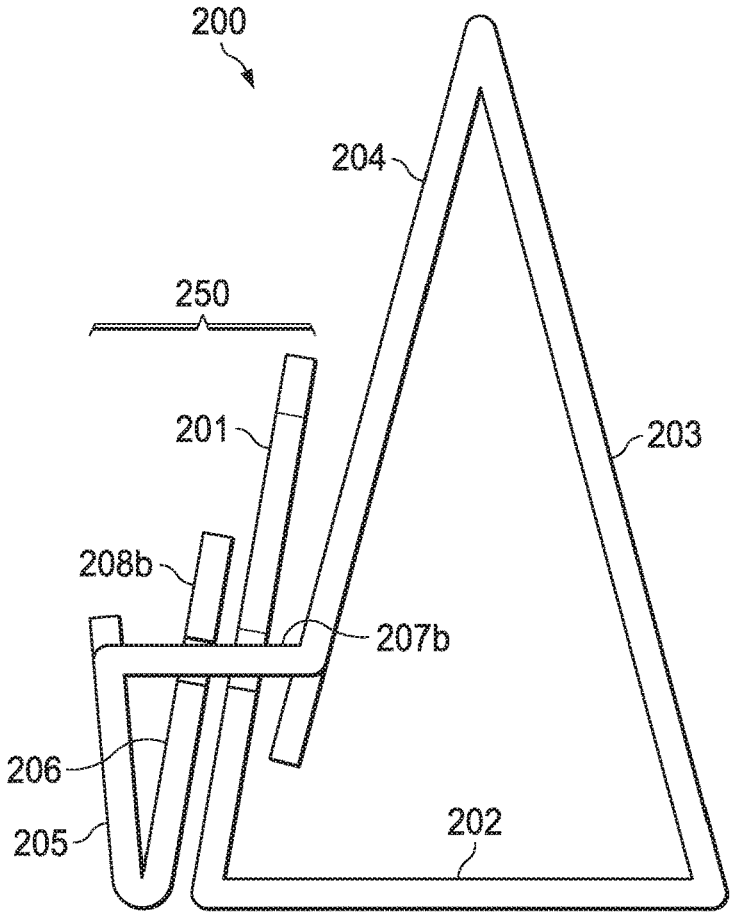
Figure 2A:
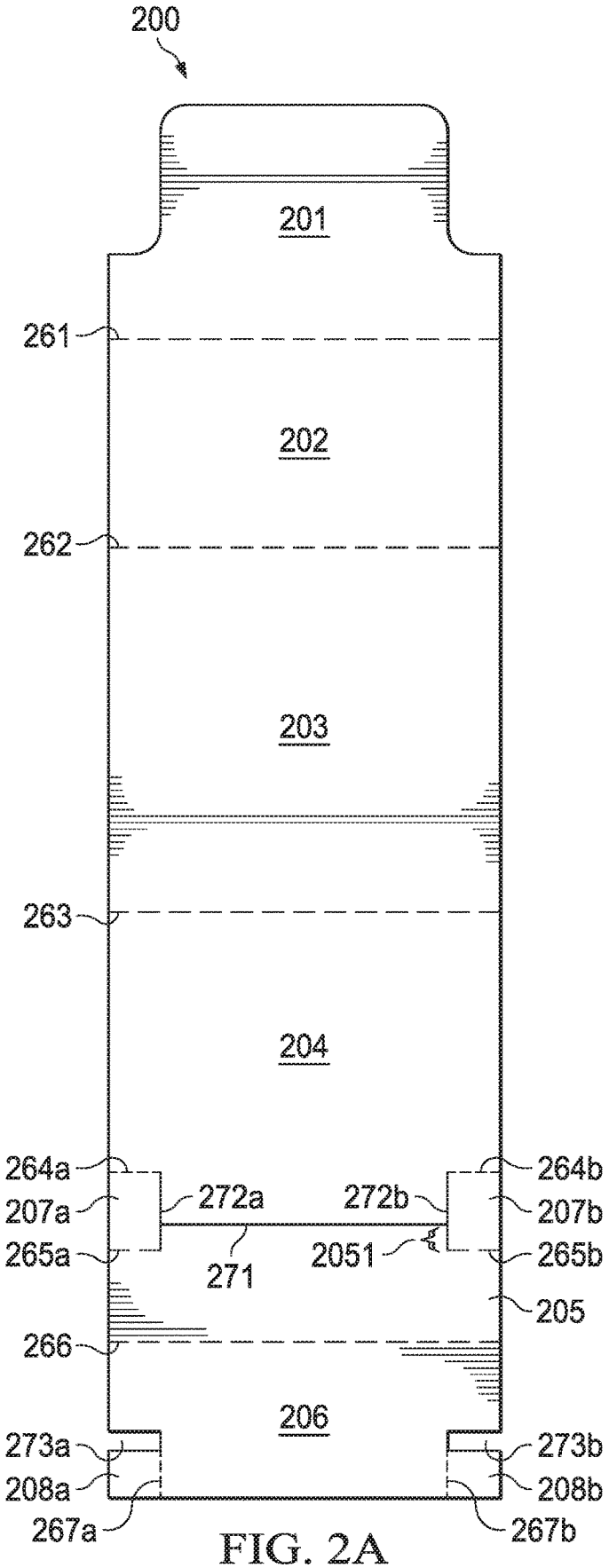
Figure 2C:
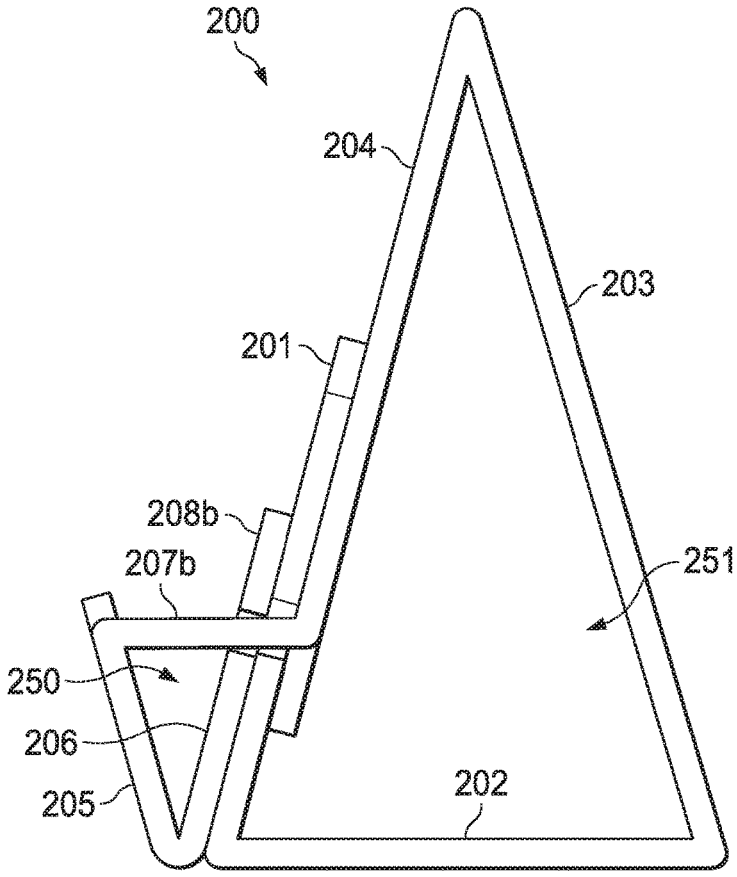
Figure 2E:
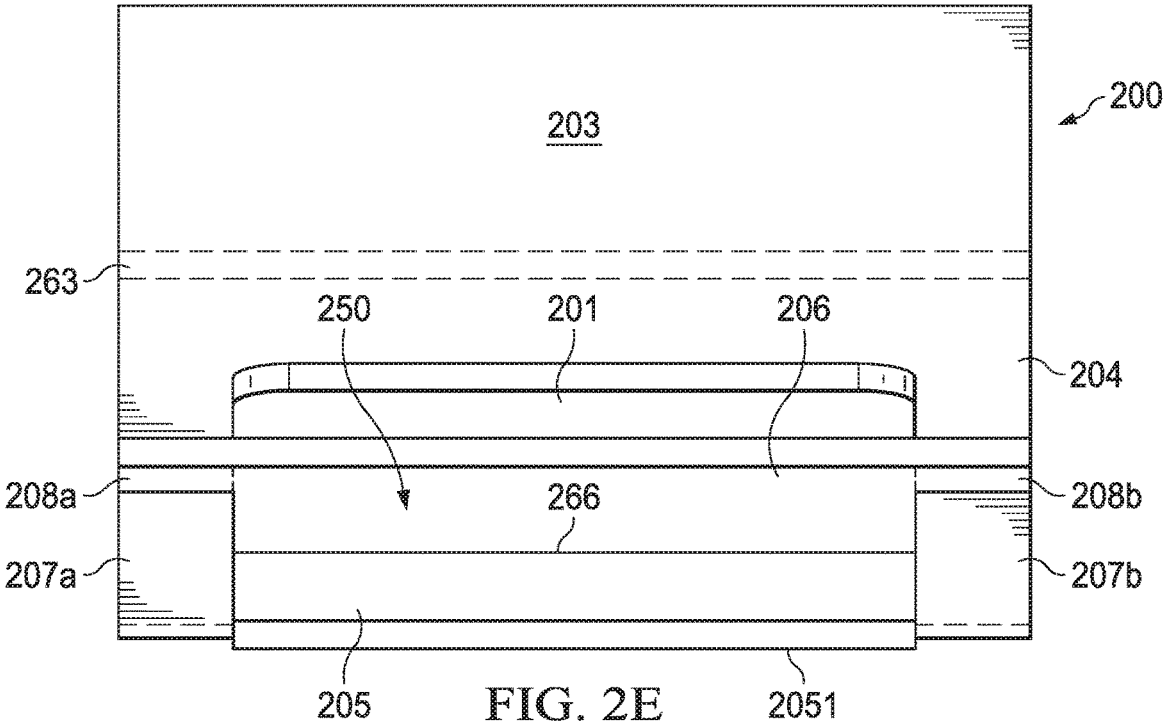
Figure 2D:
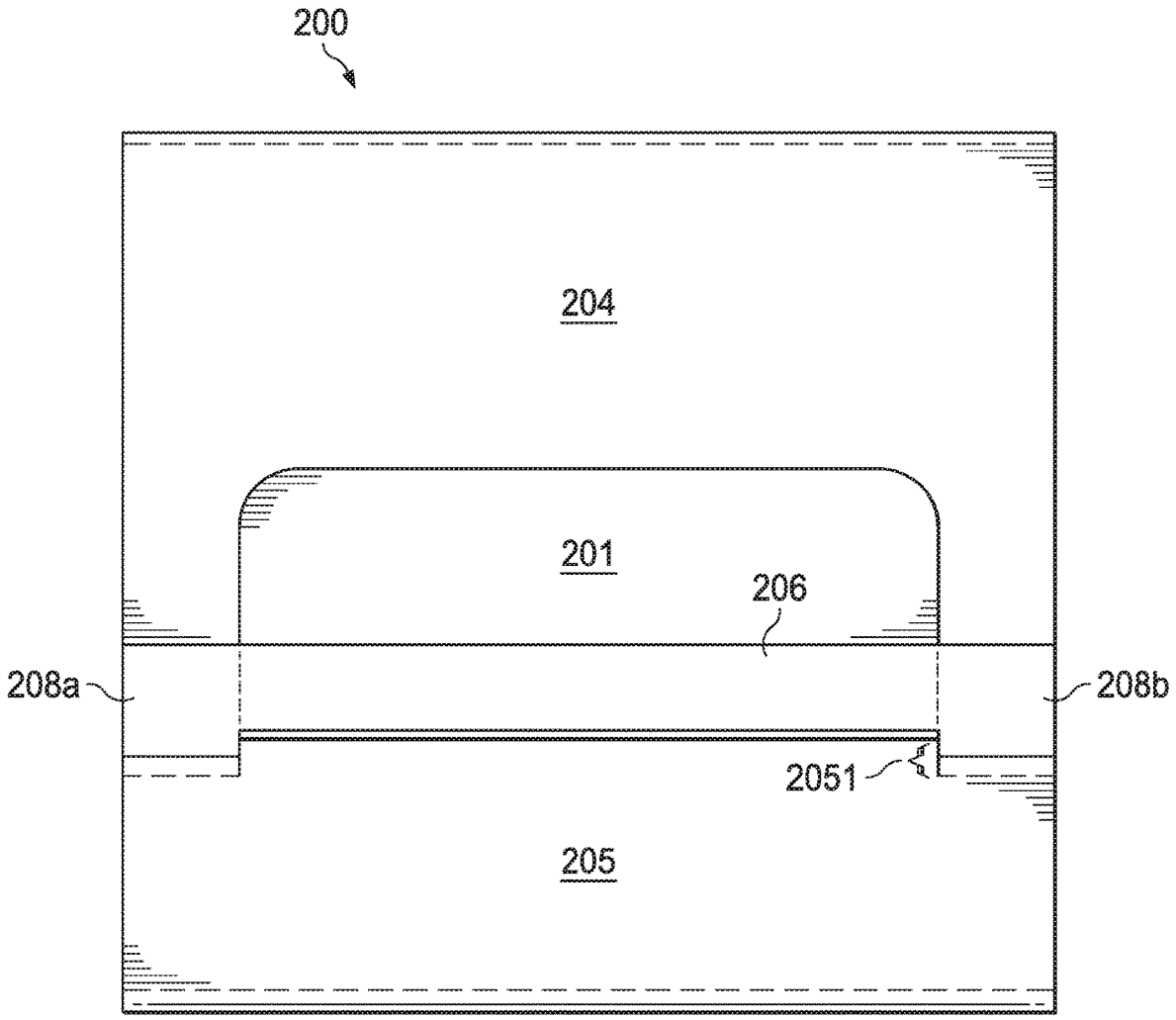
Figure 3:
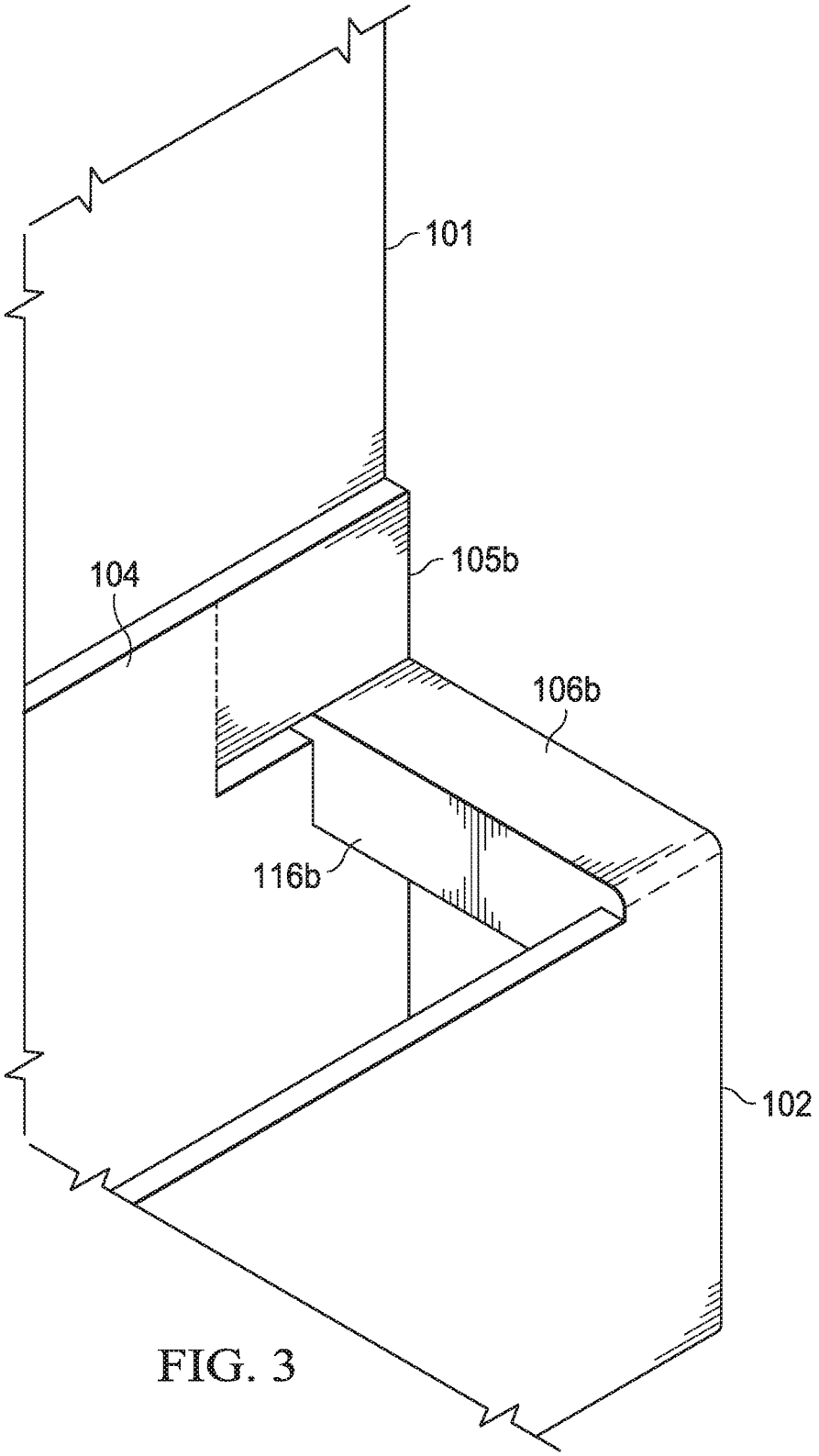

FIG. 3 depicts an alternative arrangement for a surface of the pocket holder of FIGS. 1A-1E and a surface of the easel of FIGS. 2A-2E.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

The pocket holder described herein serves one main function expressed as a mode. The mode of the pocket holder to hold or contain one or more items. Such items may include: papers, form papers, documents, identification documents, clipboards, paper tablet, marker board, writing implements, erasers, chalk, rulers, cards, business cards, paper clips, tools, fasteners, push pins, nuts, bolts, screws, nails, electronic devices, and/or combinations thereof. The pocket holder may be secured to a surface of a building such as wall, door, window, ceiling, or floor. The pocket holder may be secured to a piece of furniture such as a book case, desk, table, or appliance, such as a computer, a lamp, a refrigerator, a washer, a dryer, etc. The pocket holder may be secured to a vehicle such as a car or truck. The pocket holder may be secured to such places using glue, tape, magnet(s), hook and loop fastener, screw(s), nail(s), hook(s), or other fastener(s) both removable or permanent types. The pocket holder may serve as a pocket protector that is inserted into an article of clothing, such as a clothing pocket, e.g. shirt pocket, pants pocket, jacket pocket, or vest pocket. The pocket holder may also serve as belt holder, which has one or more slits cut into the pocket holder, such that the pocket holder is threaded through a belt or strap. The pocket holder may also be similarly secured to a personal item such as a purse, briefcase, suitcase, backpack, or satchel. The pocket holder described herein may be resized as needed to accommodate different sized items.

The easel described herein serves one main function expressed as a mode. The mode of the easel is the display one or more items. As used herein display is defined as both a static display and a dynamic display. A static display is the display of an item that does not change, such as displaying a finished painting, a printed picture, or completed information such as a map. A dynamic display is the display of an item that changes with time. For example, a dynamic display is a painting that in being painted. A dynamic display may include an electronic device that can display a slide show of picture, a bulletin board that allows papers and other things to be mounted on the bulletin board. The item may be a marker board, a chalk board, or a paper tablet. The easel may be placed on a horizontal surface of a building such as floor or window sill. The easel may be placed on a piece of furniture such as a book case, desk, table, or appliance, such as a computer, a refrigerator, a washer, a dryer, etc. The easel may be placed on a horizontal surface a vehicle such as a dash board. The easel may be placed without being fixedly attached. Alternatively, the easel may be fixedly attached using one or more fasteners described above with respect to the pocket holder. Heavy or large items may unbalance the easel, and thus to prevent tipping over, a weight may be placed inside the support triangle 251 (FIG. 2C) to stabilize the easel. The easel described herein may be resized as needed to accommodate different sized items.

As used herein, an electronic device may be a portable electronic device, a computer device, a display screen, an image projector, an IPAD, a notebook computer, an MP3 player, a personal data assistant, a cellular telephone, a camera, and a smart phone.

The pocket holder and easel described herein are preferably made from materials that have been used for other purposes. Thus, the pocket holder and easel described herein are preferably made from recycled materials.

One example of such a material is cardboard. The cardboard may be a portion of the packaging for the item(s) to be held or displayed. The cardboard may be packaging from other products, such as the cardboard backing from note pads. The cardboard should have sufficient strength to hold the item. The cardboard is preferably made of one piece that is sized to accommodate the item. The cardboard may be corrugated or non-corrugated. It is preferable that the cardboard be corrugated for the pocket holder or easel and be oriented such that the internal corrugation of the cardboard is perpendicular to the major structural folds, e.g. folds 163, 164, 261, 262, 263, and 266. This is preferable to provide greater strength to surfaces 106*a,b* of FIGS. 1A and 1B, and surfaces 207*a,b* of FIG. 2A. However, the corrugation may be oriented parallel to the major structural folds. Note that the cardboard material may be coated with a water resistant material and/or reinforcing material, e.g. spray rubber or plastic coating, to provide some weather protection for the device and/or improve the durability of the container. FIGS. 2A-2E depict using thin cardboard to form the easel 200. Cardboard could also be used to form the pocket holder 100 of FIGS. 1A-1E.

Another example of such a material is corrugated plastic. One example of corrugated plastic is polypropylene plastic or PP plastic and is typically marked with the recycling number 5. Polypropylene is desirable because the plastic is resistant to fatigue, and thus can be bent or folded multiple times without breaking. Note that other plastics may be used. The corrugated plastic may be a portion of the packaging for the item(s) to be held or displayed. The corrugated plastic may be packaging from other products, or from other sources such as a yard sign, e.g. political signs, real estate signs. The corrugated plastic should have sufficient strength to support the item. Corrugated plastic has two common thickness sizes, 2 and 4 millimeters. The 2 millimeter thick plastic has corrugation cell chambers that are 2 millimeters thick and about 3 millimeters in length. The 4 millimeter thick plastic has corrugation chambers that are 4 millimeters thick and about 5.5 millimeters in length. The corrugation cell typically has a mostly square cross-section. The corrugated plastic is preferably made of one piece that is sized to accommodate the device.

It is preferable that the plastic be corrugated for the pocket holder and/or easel and be oriented such that the internal corrugation of the plastic is perpendicular to the major structural folds, e.g. folds 163, 164, 261, 262, 263, and 266. This is preferable to provide greater strength to surfaces 106*a,b* of FIGS. 1A and 1B, and surfaces 207*a,b* of FIG. 2A. This is also preferable for simplicity. To form a fold that is parallel, the plastic strip between two cells may need to be removed, meaning two cuts to form one fold. However, the corrugation may be oriented parallel to the major structural folds. Note that if corrugated plastic is used, then to make the various cuts for the container may require additional material to be removed to form cavities instead of only cutting plastic. For example, the strip of plastic between the cell walls of the corrugation may be removed in its entirety rather than make one cut in the cell. This will better allow the folding to occur. FIGS. 1A-1E depict using corrugated plastic to form the pocket holder 100. Corrugated Plastic could also be used to form the easel 200 of FIGS. 2A-2E.

As used herein, a peak fold is a fold that forms an inverted letter v, with the peak facing upward with respect to the view or out of the page with respect to the view. A valley fold is a fold that forms a letter v, with the peak facing downward with respect to the view or into the page with respect to the view.

FIGS. 1A and 1B depict a first embodiment of the pocket holder 100. FIG. 1A depicts a top view of the pocket holder 100 in an unfolded state, and FIG. 1B depicts a bottom view of the pocket holder 100 in an unfolded state. The pocket holder may be formed by using a one or more die(s) in a press to cut the pattern. The various peak and valley folds may also be formed by one or more die(s) in a press. Alternatively, a pattern for the pocket holder may be traced or printed onto a piece of material, and the various cuts and folds may be made by hand.

Note that the corrugation of the plastic is parallel to the major folds. Thus, the folds 162*a,b*, 163, 164 are formed by removing the strip of plastic between two corrugated cells, thereby opening a cell channel. Thus, in FIG. 1A these folds have the cell channel open, whereas in FIG. 1B, the folds are depicted as dotted lines that are hidden in this view. If the corrugation was perpendicular to the major folds, then only a single cut would have been needed, such as the single cut for folds 165*a,b*.

The pocket holder 100 comprises the Back Surface 101, the Front Pocket Surface 102, the Bottom Pocket Surface 103, the Rear Pocket Surface 104, the Pocket Latch Tabs 105*a,b*, and the Upper Pocket Side Surface 106*a,b*. The pocket holder 100 includes back surface 101, which is the main supporting surface for the pocket holder 100. This surface would be used to attach the pocket holder to another object, such as a surface of a building, a piece of furniture, a vehicle, an article of clothing, or a personal item. This surface may also include written information, such as a logo or an identification. This surface may also be used to attach various papers or documents, e.g. a sticker.

The pocket holder 100 also includes the pocket 120 (FIGS. 1C and 1E) which is formed from the Front Pocket Surface 102, the Bottom Pocket Surface 103, the Rear Pocket Surface 104, the Pocket Latch Tabs 105*a,b*, and the Upper Pocket Side Surfaces 106*a,b*. The front pocket surface 102 forms the front of the pocket 120. The bottom pocket surface 103 forms the bottom of the pocket 120. The rear pocket surface 104 forms the rear of the pocket. The pocket latch tabs 105*a,b* lock the pocket 120 against the back surface 101. The upper pocket side surfaces 106*a,b* form the sides of the pocket 120.

In FIGS. 1A and 1B the pocket holder 100 has a plurality of folds. The Top Rear Folds are the folds between the back surface 101 and the upper pocket side surfaces 106*a,b*. The Front Folds 162*a,b* are the folds between upper pocket side surfaces 106 *a,b* and the front pocket surface 102. The Bottom Front Fold 163 is the fold between the front pocket surface 102 and the bottom pocket surface 103. The Bottom Rear Fold 164 is the fold between the bottom pocket surface 103 and the rear pocket surface 104. The Tab Folds 165*a,b* are the folds between the rear pocket surface 104 and the pocket latch tabs 105*a,b*.

Folds 161*a,b* are peak folds with respect to FIG. 1A. Folds 162*a,b*; 163, 164 are all valley folds with respect to FIG. 1A Folds 165*a,b* are bidirectional with respect to FIG. 1A meaning that these folds can be either peak or valley or both. With respect to FIG. 1B, the folds are reversed, with folds 161*a,b* are valley folds and folds 162*a,b*; 163, 164 are peak folds. Again folds 165*a,b* are bidirectional.

In FIGS. 1A and 1B the pocket holder 100 has a plurality of cuts. The Pocket Cut 171 is the cut between the back surface 101, the front pocket surface 102, and the upper pocket surface 106*a,b*. When the device is folded, this cut forms the cavity that becomes the pocket 120. Tab Cuts 172*a,b* are cuts made between rear pocket surface 104 and the pocket latch tabs 105*a,b* and form the Pocket Latch Tabs 105*a,b*.

FIGS. 1C-1E depict the assembled pocket holder 100 of FIGS. 1A and 1B. FIG. 1C depicts a side elevation view of the pocket holder 100. FIG. 1D depicts a front elevation view of the pocket holder 100. FIG. 1E depicts a top elevation view of the pocket holder 100.

To form the pocket holder 100, the pocket latch tabs 105 *a,b* are folded under the rear pocket surface 104. Alternatively, the pocket latch tabs 105*a,b* may folded over the rear pocket surface 104. The pocket latch tabs 105*a,b*, along with the rear pocket surface 104, is lifted up with respect to front pocket surface 102 and the bottom pocket surface 103, as viewed from FIG. 1A. The back surface 101 is also lifted up with respect to front pocket surface 102 and the bottom pocket surface 103, as viewed from FIG. 1A. This lifting of the back surface 101 opens a hole between back surface 101 and the front pocket surface 102 from the pocket cut 171. Next, the pocket latch tabs 105*a,b* and a portion of the rear pocket surface 104 are pushed into the hole to contact the underside of back surface 101, as viewed from FIG. 1A. The pocket latch tabs 105*a,b* are then unfolded. Finally, the rear pocket surface 104 is pushed back against a portion of the back surface 101. The pocket 120 is formed. The pocket holder 100 is now formed and ready for use. To use the pocket holder 100, one or more items are placed into the pocket 120 of the pocket holder 100. See also FIGS. 2A-2C of the related application namely U.S. patent application Ser. No. 16/386,220, filed on 16 Apr. 2019, entitled A CONTAINER AND STAND FOR A PORTABLE DEVICE, the disclosure of which is hereby incorporated herein by reference in its entirety.

Note that in FIG. 1C, the cross-section of the pocket 120 is a rectangle. The sizes of the different surfaces of the pocket 120 may be varied to yield other four-sided shapes, such as a square, or a parallelogram. Other surfaces may be added or removed to form other cross-sections such as a triangle, a pentagon, or other polygon shapes. Note that the number and dimensions of the surfaces may be modified, and the dimensions and locations of the folds and cuts may be modified to allow for different sized items to be placed in the pocket holder.

FIG. 2A depicts an embodiment of the easel 200. FIG. 2A depicts a top view of the pocket holder 100 in an unfolded state. The easel 200 in this embodiment is made from thin cardboard, and thus a bottom view would be the same as the top view, except for the direction of the peak and valley folds. The pocket holder may be formed by using a one or more die(s) in a press to cut the pattern. The various peak and valley folds may also be formed by one or more die(s) in a press. Alternatively, a pattern for the pocket holder may be traced or printed onto a piece of material, and the various cuts and folds may be made by hand.

The easel 200 comprises the Flap Surface 201, the Base Surface 202, the Back Surface 203, the Front Top Surface 204, the Front Pocket Surface 205, the Lower Inside Surface 206, the Side Support Surfaces 207*a,b*, the Pocket Latch Tabs 208*a,b*. The flap surface 201, the base surface 202, the back surface 203, and the front top surface 204 form the support triangle 251 (FIG. 2C). The flap surface 201 and the front top surface 204 form one side of the support triangle 251. The back surface 203 forms another side of the support triangle 251. The base surface 202 forms another side of the support triangle 251. The base surface 202 would be placed upon an external surface or object upon which the easel rests during use. The external surface may be a portion of a piece of furniture, e.g. a table, or other object, e.g. the user's lap, torso, chest, abdomen, or hand, upon which the user(s) is going to view or use the item on the easel. The base surface 202 may merely rest upon the surface or may be fixedly attached to the object surface using one or more fasteners described above.

The easel 200 also includes the pocket triangle 250 (FIG. 2C), which is formed from the Front Pocket Surface 205, the Lower Inside Surface 206, the Side Support Surfaces 207*a, b*, and the Pocket Latch Tabs 208*a,b*. The front pocket surface 205 forms the front of the pocket triangle 250 and one side of the triangle. The lower inside surface 206 forms the rear of the pocket triangle 250, and another side of the triangle. The side support surfaces 207*a,b* form the upper sides of the pocket triangle 250, and another side of the triangle. The pocket latch tabs 208*a,b* lock the pocket triangle 250 against the flap surface 201.

The Notch 2051, is an optional feature, which allows for oversized objects to be placed on the easel 200. In this case, an oversized object would not rest in the pocket triangle 250, but rather would rest on top on side support surfaces 207*a,b*. The notch 2051 would prevent the object from slipping off the easel 200. A similar feature may be provided with the pocket holder 100.

In FIG. 2A the easel 200 has a plurality of folds. The Front Bottom Fold 261 is the fold between the flap surface 201 and the base surface 202. The Back Bottom Fold 262 is the fold between the base surface 202 and the back surface 203. The Top Fold 263 is the fold between the back surface 203 and the front top surface 204. The Rear Side Folds 264*a,b* are the folds between the front top surface 204 and the side support surfaces 207*a,b*. The Front Side Folds 265*a,b* are the folds between the side support surfaces 207*a,b* and the front pocket surface 205. The Pocket Bottom Fold 266 is the fold between the front pocket surface 205 and the lower inside surface 206. The Tab Folds 267*a,b* are the folds between the lower inside surface 206 and the pocket latch tabs 208*a,b*.

Folds 261, 262, 263, 265*a,b*, and 266 are peak folds with respect to FIG. 2A. Folds 264*a,b* are valley folds with respect to FIG. 2A Folds 267*a,b* are bidirectional with respect to FIG. 2A meaning that these folds can be either peak or valley or both. For a bottom view (not shown), the peak and valley folds would be reversed.

In FIG. 2A the easel 200 has a plurality of cuts. The Front Pocket Cut 271 is the cut between the front top surface 204 and the front pocket surface 205. The Side Pocket Cuts 272*a,b* are the cuts between the front top surface 204 and the side support surfaces 207*a,b* and the front pocket surface 205. When the device is folded, the cut 271 and the 272*a,b* cuts form the cavity that becomes the triangle pocket 250. The Tab Cuts 273*a,b* are the cuts between the lower inside surface 206 and the pocket latch tabs 208*a,b* and form the Pocket Latch Tabs 208*a,b*.

FIGS. 2B-2E depict the assembled easel 200 of FIG. 2A. FIGS. 2B and 2C depict side elevation views of the easel 200. In FIG. 2B, the surfaces are depicted with slight gaps between them for a better understanding of their arrangement. Such gaps would not be present or at least minimized in the assembled easel 200. FIG. 2D depicts a front elevation view of the easel 200. FIG. 2E depicts a top elevation view of the easel 200.

To form the easel 200, the pocket latch tabs 208 *a,b* are folded under the lower inside surface 206. Alternatively, the pocket latch tabs 208*a,b* may be folded over the lower inside surface 206. The pocket latch tabs 208*a,b*, along with the lower inside surface 206 and the front pocket surface 205, is pushed up with respect to the front top surface 204, as viewed from FIG. 2A. This lifting opens a hole between the front pocket surface 205 and the front top surface 204 from the front pocket cut 271 and the side pocket cuts 272*a,b*. Next, the pocket latch tabs 208*a,b* and a portion of the lower inside pocket surface 206 are pushed into the hole to contact the topside of the front top surface 204, as viewed from FIG. 2A. The pocket latch tabs 208*a,b* are then unfolded. The lower inside surface 206 is pushed back against a portion of the front top surface 204. The pocket triangle 250 is formed. The flap surface 201 is folded under the base surface 202, the back surface 203, and the front top surface 204. The flap surface is then tucked in between the front top surface 204 and the lower inside surface 206. The support triangle 251 is formed. The easel 200 is now formed and ready for use. To use the easel 200, one or more items are placed into the pocket triangle 250 of the easel 200. For comparison, FIGS. 2A-2C of the related application namely U.S. patent application Ser. No. 16/386,220, filed on 16 Apr. 2019, entitled A CONTAINER AND STAND FOR A PORTABLE DEVICE, the disclosure of which is hereby incorporated herein by reference in its entirety.

Alternatively, the formation of the easel may have the support triangle formed first, and then the pocket triangle formed. This manner is useful when the flap surface 201 is elongated in the direction of the surfaces 202, 203. The elongated flap surface provides support for taller objects.

Note that in FIG. 2C, the cross-section of the pocket triangle 250 and the support triangle 251 are triangles. The sizes of the different surfaces of the pocket triangle 250 and the support triangle 251 may be varied to yield other triangle shapes. Other surfaces may be added or removed to form other cross-sections such as a square, rectangle, parallelogram, a pentagon, or other polygon shapes. Note that the number and dimensions of the surfaces may be modified, and the dimensions and locations of the folds and cuts may be modified to allow for different sized items to be placed in the easel.

FIG. 3 depicts an alternative arrangement for a surface of the pocket holder of FIGS. 1A-1E and a surface of the easel of FIGS. 2A-2E. In FIG. 3, the Upper Pocket Side Surface 106*b* has lower extension 116*b*. One side of extension 116*b* contacts the rear pocket surface 104 and the other side contacts the front pocket surface 102 (not shown). The lower extension 116*b* helps maintain the cross-sectional shape of the pocket, in this case a rectangle. A similar extension can be formed on the side support surfaces 207*a,b* of easel 200. This extension would require one more fold and two cuts for each extension. The extension would be shaped according to the desired cross-section, for example with the easel 200, the extension would be triangular shaped.

Note that the cross-sectional shapes described herein may not be exact. Differences in the various dimensions of the cuts, folds, and surfaces may cause the cross-section of the pocket 120, the pocket triangle 250, and the support triangle 251 to be more polygon-shaped. Additionally, heavy or light items may also cause distortions in the cross-sections of the pocket 120, the pocket triangle 250, and the support triangle 251 to make the cross-sections more polygon-shaped. Thus, as used herein terms such as triangle, square, rectangle, parallelogram, etc. used to describe a shape, should be understood to mean substantially triangle, substantially square, substantially rectangle, substantially parallelogram, etc.

As used herein, the words "comprise," "have," "include," and all grammatical variations thereof are each intended to have an open, non-limiting meaning that does not exclude additional elements or steps.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An easel that holds an item, the easel comprises:

a pocket that holds the item; and a support that is adjacent to and in contact with the pocket;

wherein the pocket comprises:

first and second pocket latch tabs that are adjacent to and in contact with the support;

a lower inside surface that connected to the first and second pocket latch tabs;

a front pocket surface that is connected to the lower inside surface and proximate to the support;

first and second side support surfaces that are each connected to the front pocket surface and the support;

wherein the lower inside surface and the front pocket surface, and the first and second side support surfaces are proximate with each other to form the pocket that has a polygon shaped cross-section;

wherein the support comprises:

a flap surface that is adjacent to the pocket and in contact with the lower inside surface;

a base surface that is connected to the flap surface;

a back surface that is connected to the base surface;

a front top surface that is connected to the back surface and the first and second side support surfaces;

wherein the flap surface and the base surface, the back surface, and the front top surface are proximate with each other to form the support that has a polygon shaped cross-section;

wherein the pocket and the support are formed from a single piece of material.

2. The easel of claim 1, wherein the cross-section of the pocket is a triangle, and the cross-section of the support is a triangle.

3. The easel of claim 1, wherein at least one item is placed into the pocket of the holder.

4. The easel of claim 1, wherein the material is at least one of a biodegradable material, a recycled material, a cardboard material, a polypropylene plastic, or a corrugated material.

5. The easel of claim 4, wherein the material is a polypropylene plastic that has corrugations, wherein the easel comprises:

a plurality of folds;

wherein a majority of the plurality of folds is perpendicular to a direction of the corrugations.

6. The easel of claim 1, wherein the front pocket surface comprises a notch, wherein a large item that has a dimension that is larger than a dimension of the pocket is placed onto the easel and is supported by the first and second side support surfaces and the notch.

7. The easel of claim 1, wherein the pocket holds the item for display.

* * * * *